United States Patent [19]

Nakaoda et al.

[11] Patent Number: 4,897,018

[45] Date of Patent: Jan. 30, 1990

[54] APPARATUS FOR STACKING VENEER SHEETS

[75] Inventors: Toshinori Nakaoda; Teruaki Aoto; Nagara Aoyama; Tsuyoshi Nakamura, all of Ohbu, Japan

[73] Assignee: Meinan Machinery Works, Inc., Japan

[21] Appl. No.: 191,035

[22] Filed: May 6, 1988

[30] Foreign Application Priority Data

May 7, 1987 [JP] Japan ..... 62-111609
Sep. 11, 1987 [JP] Japan ..... 62-229229

[51] Int. Cl.[4] ..... B65H 29/34

[52] U.S. Cl. ..... 414/794.2; 271/85; 271/176; 271/189; 414/789.6; 414/794.4

[58] Field of Search ..... 414/69, 76, 77, 82, 414/789.6, 794, 794.2, 794.4; 271/9, 85, 176, 189, 191

[56] References Cited

U.S. PATENT DOCUMENTS

| | | | |
|---|---|---|---|
| 2,019,843 | 11/1935 | Clark | 414/77 X |
| 2,767,534 | 10/1956 | Nydegger et al. | 414/794 X |
| 3,545,744 | 12/1970 | Herman | 271/189 X |
| 3,651,961 | 3/1972 | Hayes | 414/794 X |
| 4,284,382 | 8/1981 | Silverman | 271/85 X |
| 4,316,758 | 2/1982 | Suzuki et al. | 414/69 X |
| 4,624,455 | 11/1986 | Radek et al. | 271/85 |

FOREIGN PATENT DOCUMENTS

| | | | |
|---|---|---|---|
| 52-11573 | 1/1977 | Japan | 271/84 |
| 56-133104 | 3/1980 | Japan . | |
| 63-171759 | 7/1988 | Japan . | |
| 2054527 | 5/1979 | United Kingdom . | |

*Primary Examiner*—Robert J. Spar
*Assistant Examiner*—William M. Hienz
*Attorney, Agent, or Firm*—Lahive & Cockfield

[57] ABSTRACT

An apparatus for stacking veneer sheets includes a table on which to stack veneer sheets, a pair of first and second conveyors disposed on opposite sides of the table, and a veneer carrier located above the table and movable between the conveyors. The veneer carrier comprises a right veneer holding mechanism and a left veneer holding mechanism. Each holding mechanism has a veneer holder. The right veneer holder grasps a front end portion of a veneer sheet conveyed by the first conveyor, and the veneer carrier is moved to the left to carry the sheet to a drop position from which to drop the sheet. While the sheet is thus carried, it is supported at its opposed side portions by a pair of spaced apart support bars located along the direction in which the sheet is carried. Thus, the sheet is allowed to curve downwardly at its substantial rear half while it is carried. The front end portion of the sheet is intentionally curved after the sheet has been held by the right veneer holder but before the sheet is dropped from the drop position, so that the entire sheet consequently has a uniform downward curvature before it is dropped.

6 Claims, 15 Drawing Sheets

APPARATUS FOR STACKING VENEER SHEETS

FIELD OF THE INVENTION

This invention relates to apparatus for stacking veneer sheets, and particularly to apparatus for stacking veneer sheets with relatively small thicknesses, such as outer veneers for plywoods.

BACKGROUND OF THE INVENTION

A veneer stacker is well known which carries a veneer sheet, to a position in which to release the sheet, while holding substantially one entire end portion thereof and supporting opposed side portions thereof. Also, apparatus for stacking veneer sheets conveyed from two different directions, alternately or in a predetermined order, have been proposed by the applicant in Japanese Unexamined Patent Application No. 56-133104 and Japanese Patent Application No. 61-310191.

In the foregoing veneer stacker, when the sheet is carried, its front portion is kept substantially flat, but its rearward portion is downwardly curved. The sheet is released in such a state and is dropped. Since the curved portion of the sheet meets with a smaller air resistance than the front portion thereof, the curved portion drops earlier than the front portion and, hence, the entire sheet makes a landing not in the position directly below the position from which to the sheet has started to be dropped, but in a more advanced position in the direction in which the sheet has been carried. This tendency is pronounced in the case of veneer sheets with small thicknesses, for example, thicknesses of some 0.6 millimeters. Therefore it has been very difficult to stack such veneer sheets with strict accuracy. Hence, for example, where an adhesive material is applied to veneer sheets and then the sheets are stacked by using the foregoing conventional veneer stacker, veneer sheets larger than necessary are used in anticipation of an inexact stacking. Such a practice reduces the yield of the sheets.

SUMMARY OF THE INVENTION

A primary object of the invention is to provide an apparatus for stacking veneer sheets which includes a means for lowering the front end portion of a veneer sheet to curve the entire sheet uniformly before dropping the sheet, thereby stacking all sheets exactly, or in such a manner that the edges of all the sheets are aligned in vertical directions.

Other objects of the invention will become apparent upon consideration of the detailed description of the preferred embodiments of the invention.

BRIEF DESCRIPTION OF THE DRAWING

FIG. 5(*b*) shows a subroutine contained in the program of FIG. 5(*a*);

FIG. 14(*b*) shows a subroutine contained in the program of FIG. 14(*a*);

DETAILED DESCRIPTION OF THE PREFERRED EMBODIMENTS

Figure 1:
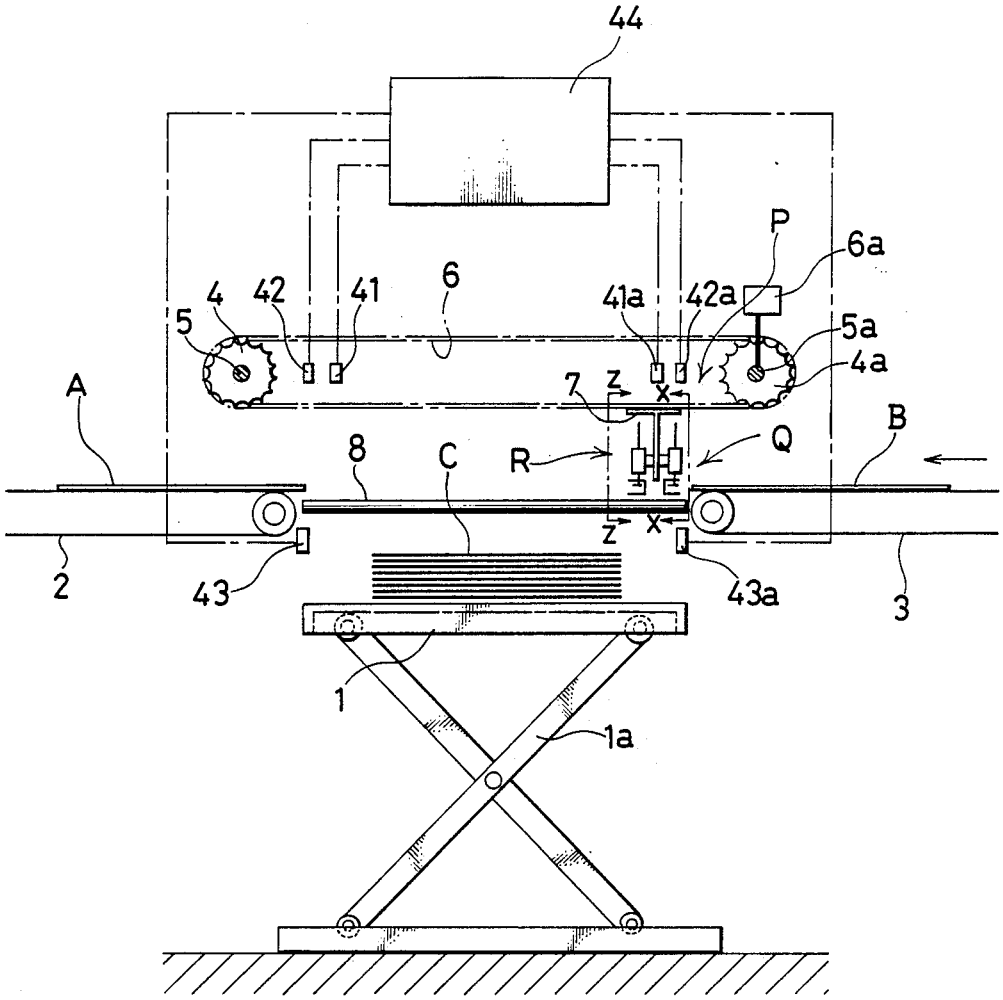
FIG. 1 is a front view of an apparatus according to the invention.

Referring now to the drawings, and to FIG. 1 in particular, there is shown an apparatus for stacking veneer sheets according to the invention. The apparatus includes a rectangular table 1 on which to stack veneer sheets. The table 1 is mounted on and supported by a pair of parallel X-shaped legs 1*a* which are vertically movable in a simultaneous and equal manner. In FIG. 1 only one leg 1*a* is shown. The table 1 thus may be vertically moved. As in the prior art, the table 1 is provided with a means for determining when the veneer sheets stacked thereon have reached a certain height (not shown), and is adapted to lower when so determined. A pair of belt conveyors 2 and 3 are opposed to each other with the table 1 located therebetween. One end of the conveyor 2 is in close proximity to one side of the table 1 as viewed from above, and one end of the other conveyor 3 is in close proximity to the opposed side of the table 1 as viewed from above. The opposed ends of the two conveyors are spaced apart from the opposed sides of the table 1 by the same distance, respectively, as viewed from above. If desired, however, the two conveyors may be so located that their opposed ends are positioned directly above the opposed side portions of the table 1, respectively. Each conveyor includes a drive mechanism having a motor and a clutch with a brake (not shown). The belt of each conveyor is intermittently operated, by this mechanism, to convey a veneer sheet or sheets placed thereon toward the table 1. The drive mechanisms are interconnected to a controller 44.

A veneer sheet A to which an adhesive material is applied at its opposed surfaces is to be placed on the conveyor 2 in such a manner that the fibers of the sheet A extend in the direction of operation of the belt of the conveyor 2. On the other hand, two veneer sheets B, mounted upon each other such that their fibers extend in the same direction, are placed on the conveyor 3 in such a manner that their fibers extend in directions perpendicular to the direction of operation of the belt of the conveyor 3. The veneer sheet A is relatively thick, and is to be used as a core veneer of a plywood. The veneer sheets B each are relatively thin, and are to be used as outer veneers of plywoods.

Above the opposed end portions of the conveyors 2 and 3 are provided a pair of parallel, rotatable horizontal shafts 5 and 5*a*, respectively, which extend in directions perpendicular to the directions of movement of the conveyor belts. Two sprockets 4 are secured to the respective end portions of the shaft 5. Correspondingly, two sprockets 4*a* are secured to the respective end portions of the shaft 5*a*. A chain 6 is fitted over two corresponding sprockets 4 and 4*a* to connect them. Another chain 6 is fitted over the other two corresponding sprockets 4 and 4*a* to connect them. A mechanism 6*a* for operating the chains 6 is located in proximity to one end of the right-hand rotatable shaft 5*a*, and is connected thereto. This operating mechanism 6*a* comprises a motor, a reversing clutch and a clutch with a brake, and rotates the right-hand shaft 5*a*, either in a clockwise direction or in a counterclockwise direction, to operate the two chains 6. Also, the operating mechanism 6*a* is interconnected to the controller 44.

A veneer carrier P is suspended from the chains 6. The veneer carrier P includes a T-shaped member 7 consisting of horizontal and vertical rectangular plates and extending in parallel with the two shafts 5 and 5*a* as viewed from above. Also the veneer carrier P includes a pair of veneer holding mechanisms Q and R located on the opposed sides of the vertical plate of the member 7. The veneer holding mechanism Q holds the sheets B conveyed by the conveyor 3. The veneer holding mechanism R holds the sheet A conveyed by the conveyor 2.

The horizontal plate of the member 7 is secured to lower portions of the chains 6 at its opposite end portions. The veneer carrier P is moved toward either the right-hand conveyor 3 or the left-hand conveyor 2, depending upon the direction of movement of the chains 6.

Figure 2:
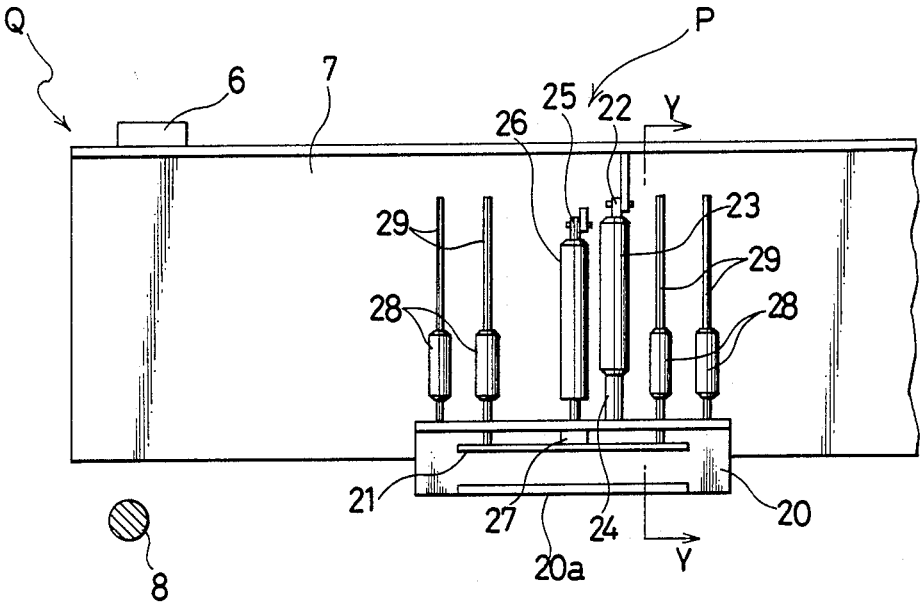
FIG. 2 is a portion of the apparatus of FIG. 1 as viewed in a X—X direction of FIG. 1.
Figure 3:
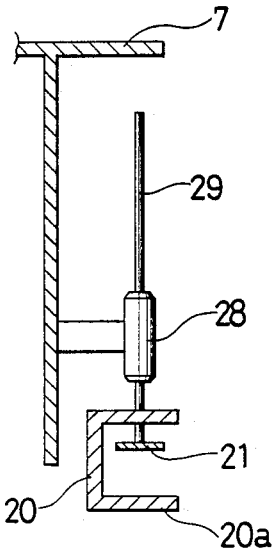
FIG. 3 is a portion of FIG. 2 as viewed in a Y—Y direction of FIG. 2.

Referring to FIG. 2, the veneer holding mechanism Q of the carrier P includes parallel piston-type cylinders 23 and 26. The cylinder 23 is suspended, at its top 22, from a vertical support fixed to the horizontal plate of the T-shaped member 7. The cylinder 26 is suspended, at its top 25, from a horizontal support fixed to the vertical plate of the T-shaped member T. An air source (not shown) such as an air tube is connected to each cylinder by means of a conduit (not shown), and supplies compressed air to each cylinder. The compressed air operates each cylinder. An electromagnetic valve (not shown) is provided in each conduit, and is interconnected to the controller 44. The controller 44 controls each valve to open or close it in order to supply each cylinder with the compressed air from the source or interrupt the supply of the compressed air therefrom. A horizontal veneer holder 20 is suspended from the bottom of the piston rod of the cylinder 23. The veneer holder 20 comprises a generally U-shaped holder body and a horizontal press plate 21. The holder body includes a vertical plate, an upper horizontal plate projecting outward from the top of the vertical plate, and a lower horizontal plate 20*a* projecting outward from the bottom of the vertical plate. The upper horizontal plate of the holder body has the same length as its vertical plate, and its lower horizontal plate 20*a* is shorter than its upper horizontal plate. The veneer holder 20 is open toward the conveyor 3 (FIG. 1). The lower end portion of the piston rod of the cylinder 26 projects downward from the upper horizontal plate of the holder body. The foregoing press plate 21 is connected to the bottom of the piston rod of the cylinder 26. The press plate 21 is parallel to the lower horizontal plate 20*a*, and has the same length as the latter plate. The veneer holder 20 is located substantially in the middle of the length of the T-shaped member 7. The veneer holder 20 functions to hold the front end portion of the whole of the sheets B. The piston rod of the cylinder 23 is movable between its uppermost position (FIG. 2) and its lowest position (not shown). When the piston rod of the cylinder 23 is in its uppermost position, the holder body, or the entire holder 20, is in its upper position (FIG. 2). When the piston rod of the cylinder 23 is in its lowest position, the holder body, or the entire holder 20, is in its lower position (not shown). When the holder body is in its upper position, the sheets B conveyed by the conveyor 3 are moved between the press plate 21 and the lower plate 20*a* until a substantial middle of the front edge of the sheets B comes in contact with the vertical plate of the holder body. The piston rod of the cylinder 26 is movable between its uppermost position (FIG. 2) and its lowest position (not shown). When the piston rod of the cylinder 26 is in its uppermost position, the press plate 21 is in its upper position (FIG. 2) relative to the holder body. When the piston rod of the cylinder 26 is extended, the press plate 21 is moved to its lower position (not shown) relative to the holder body. In its lower position, the press plate 21 presses and holds the sheets B together with the lower plate 20*a*. When the holder body is moved to its lower position, the piston rod of the cylinder 26 and, hence, the press plate 21 are concomitantly lowered under the force of the compressed air in the cylinder 26 to lower or extend the piston rod of the cylinder 26. Thus, when the holder body has come to its lower position, the piston rod of the cylinder 26 is in its lowest position. When the holder body is still in its lower position, the piston rod of the cylinder 26 starts to be retracted and the press plate 21 thus releases its hold on the sheets B. After the lapse of a certain period of time, the piston rod of the cylinder 23 also starts to be retracted. And, at substantially the same time, the piston rods of the cylinders 26 and 23 reach their uppermost positions (FIG. 2). Thus, at substantially the same time, the press plate 21 and the holder body reach their upper positions (FIG. 2). According to one preferred embodiment of the invention, the holder 20 has a length equal to a quarter of the dimension of the front edge of the sheets B. A collar 24 is connected to the lower end portion of the piston rod of the cylinder 23. Also, a collar 27 is connected to the lower end portion of the piston rod of the cylinder 26. The collars 24 and 27 function to limit the upper movement of the respective piston rods. That is, the collar 24 determines the uppermost position of the piston rod of the cylinder 23 and the collar 27 determines the uppermost position of the piston rod of the cylinder 26. A pair of vertical support rods 29 are connected to the upper horizontal plate of the holder body at their lower ends. Also, a pair of vertical support rods 29 are connected to the press plate 21 at their lower ends. Each support rod 29 extends through and is supported, for vertical movement, by a linear ball bearing 28 (FIG. 3). This bearing 28 is supported from the vertical plate of the T-shaped member 7. The support rods 29 connected to the upper horizontal plate of the holder body ensure the stable and smooth vertical movement of the holder 20. Similarly, the support rods 29 connected to the press plate 21 ensure the stable and smooth vertical movement of the plate 21. Preferably the lower limit of the stroke of the piston rod of the cylinder 23 is such that the lower horizontal plate 20*a* has its lowermost position at a level which is slightly, e.g. 100 millimeters, lower than the level of the top of the conveyor 3.

Figure 4:
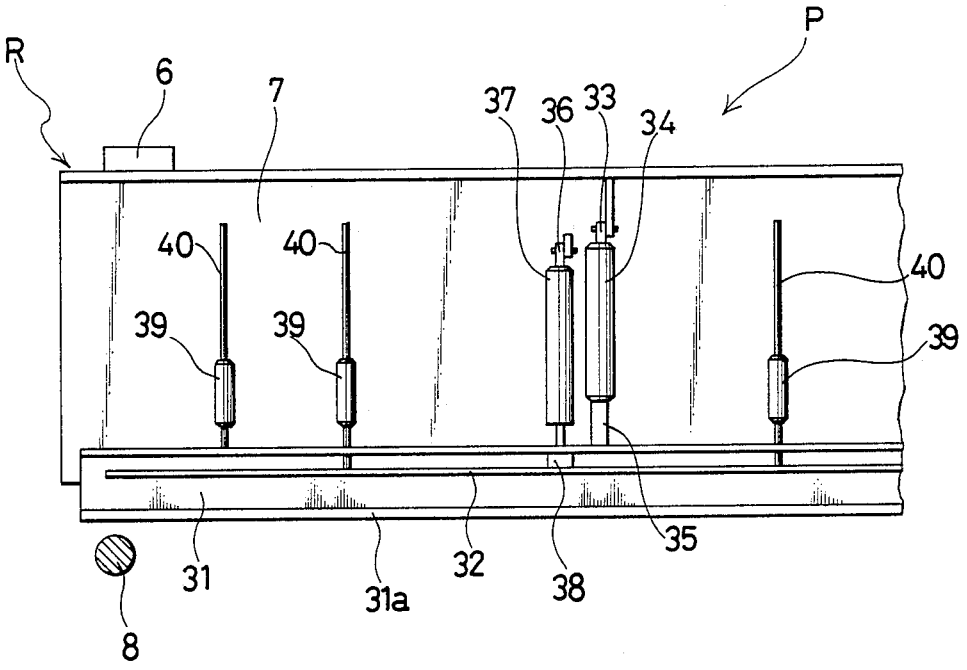
FIG. 4 is a portion of the apparatus of FIG. 1 as viewed in a Z—Z direction.

Referring to FIG. 4, the veneer holding mechanism R of the veneer carrier P has substantially the same construction as the veneer holding mechanism Q except that a veneer holder 31 has substantially the same length as the vertical plate of the T-shaped member 7. Upper and lower horizontal plates of a generally U-shaped element of the veneer holder 31 have the same length, and a horizontal press plate 32 thereof is slightly shorter than the upper and lower horizontal plates. Various operations in the veneer holding mechanism R are the same as those in the veneer holding mechanism Q except that the sheet A conveyed by the conveyor 2 is moved between the press plate 32 and the lower plate 31*a* until substantially the entire front edge of the sheet A comes in contact with the vertical plate of the U-shaped element. In FIG. 4, the piston rod of a cylinder 34 is in its uppermost position and, hence, the entire holder 31 is in its upper position. Also, in FIG. 4, the piston rod of a cylinder 37 is in its uppermost position and, hence, the press plate 32 is in its upper position relative to the U-shaped element of the holder 31.

Referring again to FIG. 1, a pair of horizontal parallel support bars 8 are located above the table 1. The bars 8 are positioned between the conveyors 2 and 3. The bars 8 function to support the sheets B, from below, at opposed side portions thereof. The bars 8 are movable between their inner positions in which to support the sheets B and their outer positions in which the bars 8 are not capable of supporting the sheets B. The inner positions of the bars 8 in which to support the sheets B are such that the bars 8 are spaced apart from each other by a distance which is a little smaller than the dimension of the front edge of the sheets B, or the width of the sheets B. The outer positions of the bars 8 in which the bars 8 are not capable of supporting the sheets B are such that the bars 8 are spaced apart from each other by a distance which is a little greater than the dimension of the front edge of the sheets B, or the width of the sheets B. A device (not shown) for moving the bars 8 between their supporting positions and nonsupporting positions is connected to the bars 8. A pistontype cylinder is suitable as this device. This device is interconnected to the controller 44.

Referring to FIG. 1, a pair of phototube switches, or veneer detectors, 43 and 43*a* are provided in conjunction with the respective conveyors 2 and 3. The detectors 43 and 43*a* are located at substantially the same levels as the bottoms of the conveyors 2 and 3, respectively. Also the detectors 43 and 43*a* are located slightly inwardly of the innermost ends of the conveyors 2 and 3, respectively. When viewed from above, the detectors 43 and 43*a* are located in the middles of the width directions of the conveyors 2 and 3, respectively. Both detectors 43 and 43*a* are interconnected to the controller 44. When the sheet A conveyed by the conveyor 2 has come to its position of FIG. 1, in other words, when the front end of the sheet A has come to the position directly above the detector 43, the detector 43 detects the front end thereof and sends a signal of the detection to the controller 44. Then, the controller 44 causes the previously-mentioned drive mechanism of the conveyor 2 to temporarily stop the conveyor 2 and, hence, the sheet A thereon. Similarly, when the sheets B conveyed by the conveyor 3 have come to the position of FIG. 1, in other words, when the front end of the sheets B has come to the position directly above the detector 43*a*, the detector 43*a* detects the front end thereof and sends a signal of the detection to the controller 44. Then, the controller 44 causes the previously-mentioned drive mechanism of the conveyor 3 to temporarily stop the conveyor 3 and, hence, the sheets B thereon.

Referring also to FIG. 1, a pair of proximity switches, or first carrier detectors, 41 and 41*a* are provided between the rotatable shafts 5 and 5*a*. Also, a pair of proximity switches, or second carrier detectors, 42 and 42*a* are provided between the shafts 5 and 5*a*, but are located outwardly of the first carrier detectors 41 and 41*a*. All detectors 41, 41*a*, 42 and 42*a* are interconnected to the controller 44. When the chains 6 are operated by the operating mechanism 6*a*, the veneer carrier P is moved. When the carrier P has come, from the right side, to its first left-hand position, or the position where the left-hand edge of the carrier P (to be more exact, the left-hand edge of the horizontal plate of the T-shaped member 7 of the carrier P) is directly below the detector 41, the left-hand edge thereof is detected by the detector 41. The detector 41 sends a signal of the detection to the controller 44. Upon receipt of the signal, the controller 44 causes the operating mechanism 6*a* to temporarily stop the chains 6 and, hence, the carrier P. That is, the carrier P is temporarily stopped in its first left-hand position. After the lapse of a certain period of time, the controller 44 causes the operating mechanism 6*a* to restart the chains 6 to move the carrier P further to the left side. And when the carrier P has come to its second left-hand position, or the position where the left-hand edge thereof is directly below the detector 42, the left-hand edge thereof is detected by the detector 42. The detector 42 sends a signal of the detection to the controller 44. Upon receipt of the signal, the controller 44 causes the operating mechanism 6*a* to stop the chains 6 and, hence, stop the carrier P. That is, the carrier P is stopped in its second left-hand position, and is not allowed to move further to the left side. After the lapse of a certain period of time, the controller 44 causes the operating mechanism 6*a* to restart the chains 6 to move the carrier P to the right side. And when the carrier P has come to its first right-hand position, or the position where the right-hand edge thereof (to be more exact, the right-hand edge of the horizontal plate of the T-shaped member 7 of the carrier P) is directly below the detector 41*a*, the right-hand edge thereof is detected by the detector 41*a*. The detector 41 sends a signal of the detection to the controller 44. Upon receipt of the signal, the controller 44 causes the operating mechanism 6*a* to temporarily stop the chains 6 and, hence, the carrier P. That is, the carrier P is temporarily stopped in its first right-hand position. After the lapse of a certain period of time, the controller 44 causes the operating mechanism 6*a* to restart the chains 6 to move the carrier P further to the right side. And when the carrier P has come to its second right-hand position, or the position where the right-hand edge thereof is directly below the detector 42*a*, the right-hand edge thereof is detected by the detector 42*a*. The detector 42 sends a signal of the detection to the controller 44. Upon receipt of the signal, the controller 44 causes the operating mechanism 6*a* to stop the chains 6 and, hence, the carrier P. That is, the carrier P is stopped in its second right-hand position, and is not allowed to move further to the right side. After the lapse of a certain period of time, the controller 44 causes the operating mechanism 6a to restart the chains 6 to the left side.

Thus the veneer carrier P is allowed to reciprocate between its second left-hand position and its second right-hand position. During the reciprocation of the carrier P various operations are performed to stack the sheets A and B on the table 1. These operations will be described below. All operations performed to stack the sheets A and B, except for operations such as the manual placement of the sheets A and B on the conveyors (and that of a sheet C on the table), are controlled by a control program of FIG. 5(*a*) included in the controller 44. The control program includes a subroutine of FIG. 5(*b*). The subroutine is executed after each step of FIG. 5(*a*) is done.

To start with, a veneer sheet C to be used as an outer veneer for a plywood is manually placed on the table 1 in such a position that the sheet A or the sheets B would occupy by being dropped from the veneer holder 31 or 20 of the carrier P. Also, a veneer sheet A to which an adhesive material is applied at its opposed surfaces is to be placed on the conveyor 2 in such a manner that the fibers of the sheet A extend in the direction of operation of the belt of the conveyor 2. On the other hand, two veneer sheets B placed on each other such that their fibers extend in the same direction are placed on the conveyor 3 in such a manner that their fibers extend in directions perpendicular to the direction of operation of the belt of the conveyor 3. Then, the power of the apparatus is turned on, thereby operating the conveyors 2 and 3 and retracting the piston rod of the cylinder 23 of the veneer holding mechanism Q and the piston rods of the cylinders 34 and 37 of the veneer holding mechanism R to their respective uppermost positions and extending the piston rod of the cylinder 26 of the mechanism Q to its lowest position. Thus, the veneer holder 20 of the mechanism Q is moved to its upper position (FIG. 2), and the veneer holder 31 of the mechanism R and the press plate 32 of the holder 31 are also moved to their upper positions (FIG. 4), but the press plate 21 of the veneer holder 20 is moved to its lower position to come in contact with the lower plate 20a thereof. Also, by turning on the power of the apparatus, the two support bars 8 are moved to their inner positions.

Then, the veneer carrier P is moved from its second right-hand position (FIG. 1) to the left side. When the carrier P has come to its first left-hand position, the carrier P is detected by the detector 41 and is stopped there. Then, the piston rod of the cylinder 23 of the mechanism Q is extended to move the veneer holder 20 of the mechanism Q to its lower position (not shown). Then, the piston rod of the cylinder 26 starts to be retracted, and thus the press plate 21 moves out of contact with the lower plate 20a. The entire holder 20 is still in its lower position. Then, the carrier P is restarted to the left side, and the support bars 8 are moved to their outer positions.

Figure 6:
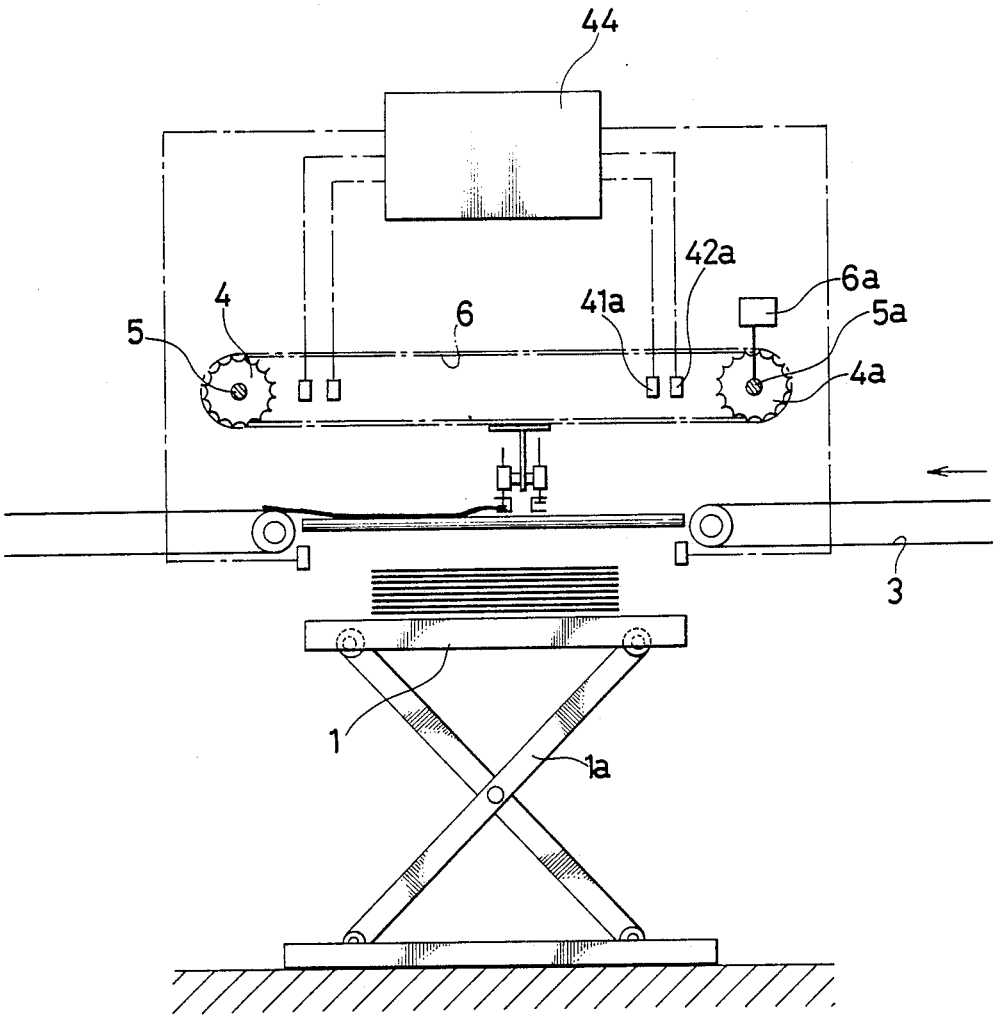
In FIG. 6, a veneer carrier of the apparatus of FIG. 1 is carrying a veneer sheet from the right to the left.

When the carrier P has come to its second left-hand position, the carrier P is detected by the detector 42 and stopped there, and the piston rod of the cylinder 23 of the mechanism Q is retracted to move the holder body to its upper position (FIG. 2). The piston rods of the cylinders 23 and 26 reach their uppermost positions (FIG. 2) at substantially the same time and, hence, the holder body and the press plate 21 reach their upper positions (FIG. 2) at substantially the same time. Then, if the sheet A conveyed by the conveyor 2 has already been detected by the veneer detector 43 and, hence, the conveyor 2 has been stopped to stop the sheet A in its detected position of FIG. 1, the conveyor 2 is restarted to move the sheet A between the press plate 32 and the lower plate 31a of the veneer holder 31 of the veneer holding mechanism R of the carrier P until substantially the entire front edge of the sheet A comes in contact with the vertical plate of the holder 31. On the contrary, if the sheet A on the conveyor has not yet been detected by the detector 43, the carrier P waits for the sheet A to be detected by the detector 43 and moved between the press plate 32 and the lower plate 31a. After the sheet A has moved in contact with the vertical plate of the holder 31, the piston rod of the cylinder 37 is extended to move the press plate 32 to its lower position, where the press plate 32 holds the front end portion of the sheet A together with the fixed plate 31a. Then, the carrier P is moved to the right side while holding the sheet A (FIG. 6). When the carrier P has come to its first right-hand position, the carrier P is detected by the detector 41a and is stopped there, and the piston rod of the cylinder 34 is extended to move the entire holder 31 to its lower position. Then, the piston rod of the cylinder 37 starts to be retracted, and thus the press plate 32 releases its hold on the sheet A. The entire holder 31 is still in its lower position. Then, the carrier P is restarted to the right side. Thus the sheet A becomes unsupported by anything, and drops by gravity on the sheet C placed on the table 1 in advance.

When the carrier P has come to its second right-hand position, the carrier P is detected by the detector 42a and is stopped there, and the piston rod of the cylinder 34 is retracted to return the holder body to its upper position. The piston rods of the cylinders 34 and 37 reach their uppermost positions (FIG. 4) at substantially the same time and, hence, the holder body and the press plate 32 reach their upper positions (FIG. 4) at substantially the same time. Also, after the carrier P has come to its second right-hand position, the support bars 8 move to their inner positions.

Figure 7:
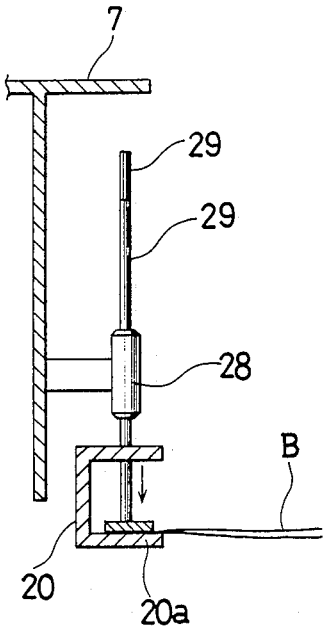
In FIG. 7, a veneer holder of a veneer holding mechanism Q of the veneer carrier is in the state of holding veneer sheets B. The holder is in its upper position.
Figure 8:
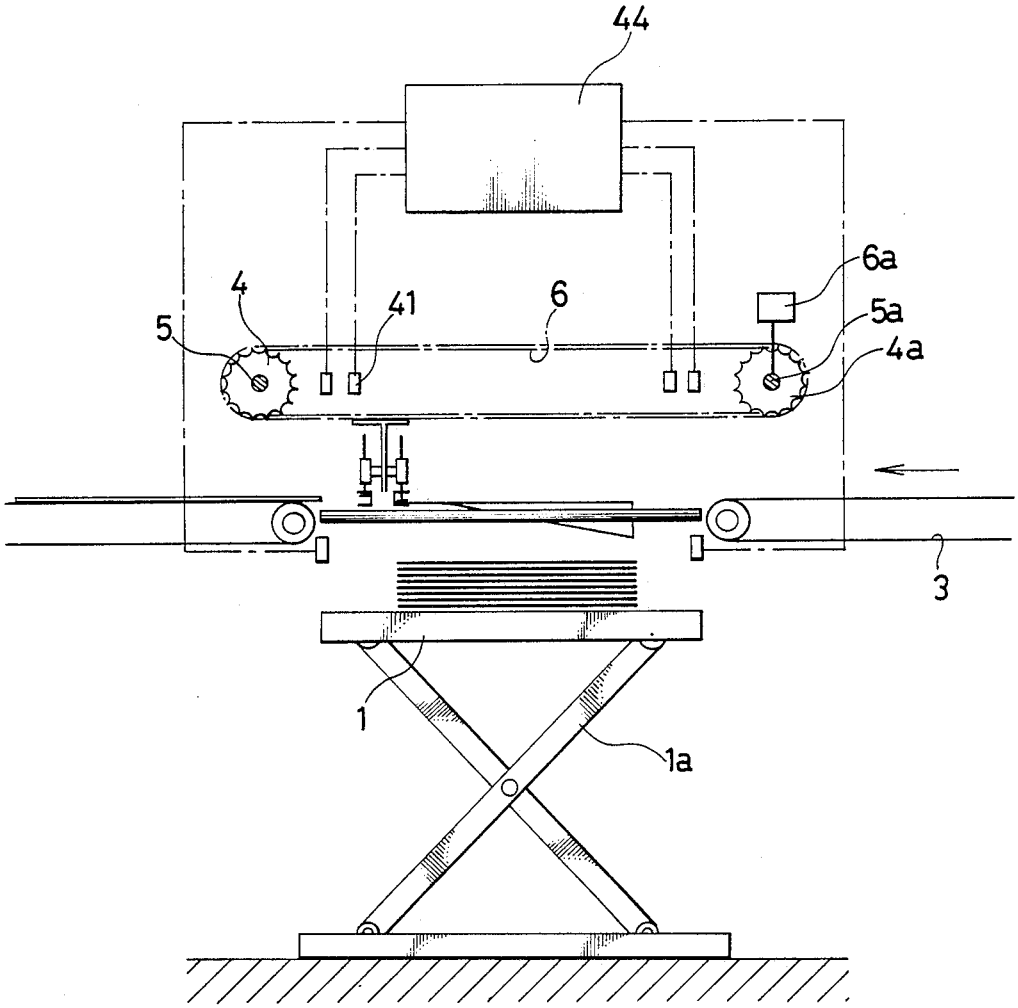
In FIG. 8, the veneer carrier is carrying the sheets B from the right to the left.

Then, if the sheets B conveyed by the conveyor 2 has already been detected by the veneer detector 43a and, hence, the conveyor 3 has been stopped to stop the sheets B in its detected position of FIG. 1, the conveyor 3 is restarted to move the sheets B between the press plate 21 and the lower plate 20a of the veneer holder 20 of the veneer holding mechanism Q of the carrier P until a substantial middle of the front edge of the sheets B comes in contact with the vertical plate of the holder 20. On the contrary, if the sheet B on the conveyor has not yet been detected by the detector 43s, the carrier P waits for the sheets B to be detected by the detector 43a and moved between the press plate 21 and the lower plate 20a. After the sheets B have moved in contact with the vertical plate of the holder 20, the piston rod of the cylinder 26 is extended to move the press plate 21 to its lower position, where the press plate 21 holds the front end portion of the sheets B together with the lower plate 20a (FIG. 7). Then, the carrier P is moved to the left side while holding the sheets B (FIG. 8). While being thus carried by the carrier P, the sheets B are supported, from below, by the bars 8 at their opposed side portions. Since the front end portion of the sheets B is held by the carrier P, the front portion of the sheets B is kept substantially flat. However, since the sheets B are relatively thin and since, unlike the sheet A, the sheets B are not held at all, at either end portion thereof in the direction of its fibers (in other words, at either of their opposed side portions), the sheets B are downwardly curved in their rearward portion as shown in FIG. 8.

Figure 9:
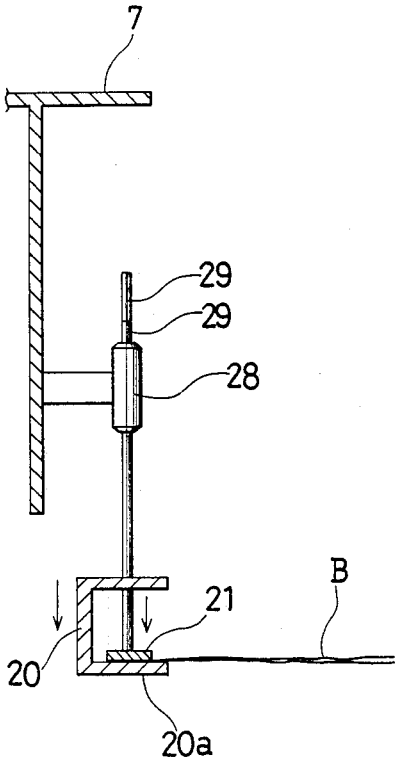
In FIG. 9, the holder has been moved from its upper position of FIG. 7 to its lower position.
Figure 10:
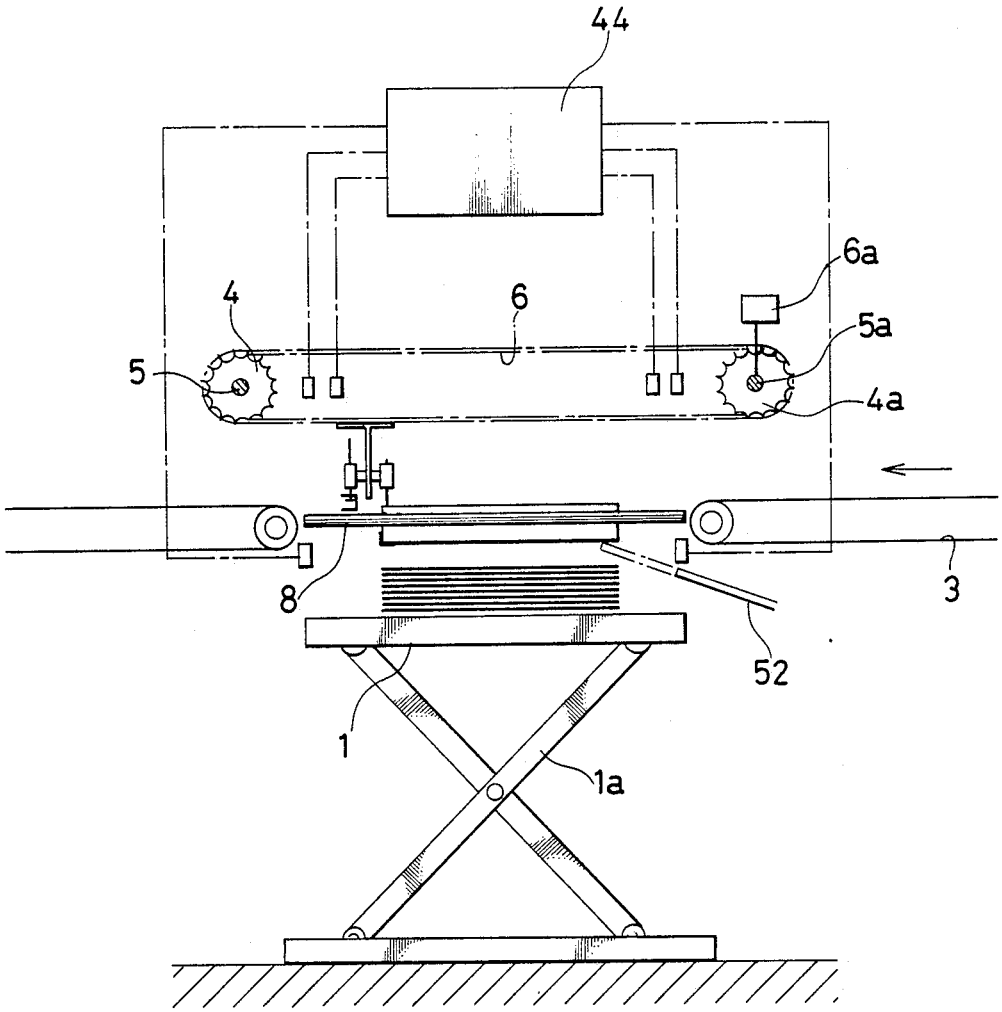
In FIG. 10, the front end portion of the sheets B carried to the left has been lowered.

When the carrier P has come to its first left-hand position, the carrier P is detected by the detector 41 and is stopped there, and the piston rod of the cylinder 23 is extended to move the entire holder 20 to its lower position. Thus the holder 20 is moved from its position of FIG. 7 to its position of FIG. 9. Therefore the portion of the sheets B held by the holder 20, namely, the middle of the front end portion of the sheets B, is lowered. Hence, the forward portion of the sheets B are downwardly curved like its rearward portion. Thus, the entire sheets B are uniformly curved in a downward direction while being supported by the bars 8 at their opposed side portions (FIG. 10).

Figure 11:
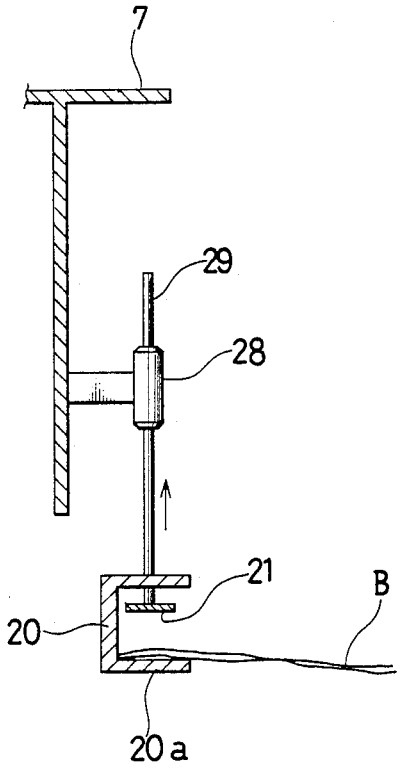
In FIG. 11, he veneer holder of the mechanism Q has released its hold on the sheets B.

Then, the piston rod of the cylinder 26 starts to be retracted, and thus the press plate 21 releases its hold on the sheets B (FIG. 11). The entire holder 31 is still in its lower position (FIG. 11). Then, the carrier P is restarted to the left side, and at the same time the support bars 8 are moved to their outer positions. Thus the sheets B become unsupported by anything, and drop by gravity on the sheet A previously placed on the sheet C on the table 1. While dropping, the sheets B are in the state of being uniformly curved. Thus the entire sheets B meet with a uniform air resistance and, hence, the sheets B may drop exactly on the sheet A. Also, the exact dropping of the sheets B is facilitated by the fact that the entire sheets B have become nearer to the sheet A by being uniformly curved in the above-mentioned manner.

After the carrier P has come to its second left-hand position, the previously-mentioned operations are repeated to perform the operation of stacking sheets A and B alternately on the table 1.

The veneer holding mechanism R is obvious from the prior art insofar as the mechanism R does not have a construction whereby the middle of the end portion of the sheet A held by the holder 31 is lowered relative to the rest of the end portion thereof before dropping the sheet A. The reason why such a prior art mechanism is sufficient is that the sheet A is held by the holder 31 at substantially entire one end portion thereof in the direction of the fibers thereof. Therefore, unlike the sheets B, the sheet A is not downwardly curved in its rearward portion, but is kept substantially flat and level. Thus the sheet A may be dropped on the sheet C with satisfactory accuracy. However, if required, the holding mechanism R may be constructed in the same manner as the holding mechanism Q.

Also, if desired, when carried by the carrier P, the sheet A, as well as the sheets B, may be supported by the bars 8, 8.

It will be appreciated that the detector 41 determines when the veneer holding mechanism Q has come to its position in which to release the sheets B. Also, the detector 42 determines when the veneer holding mechanism R has come to its position in which to hold the sheet A. From another point of view, the detector 42 determines that the mechanism Q has moved completely out of contact with the sheets B. Similarly, the detector 41*a* determines when the mechanism R has come to its position in which to release the sheet A. Also, the detector 42*a* determines when the mechanism Q has come to its position in which to hold the sheets B. From another point of view, the detector 42*a* determines that the mechanism R has moved completely out of contact with the sheet A.

Figure 12:
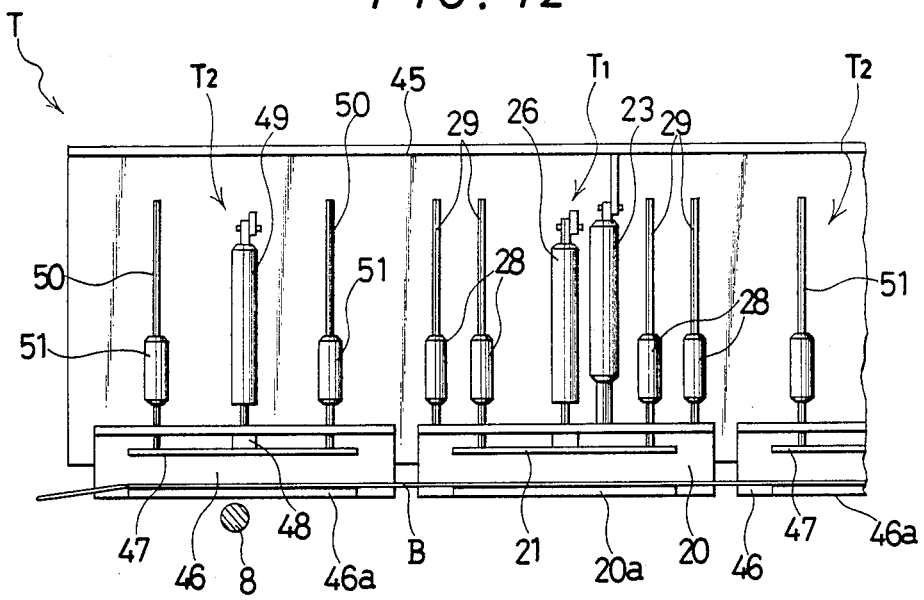
FIG. 12 shows a veneer holding mechanism T which may be used instead of the mechanism Q.
Figure 13:
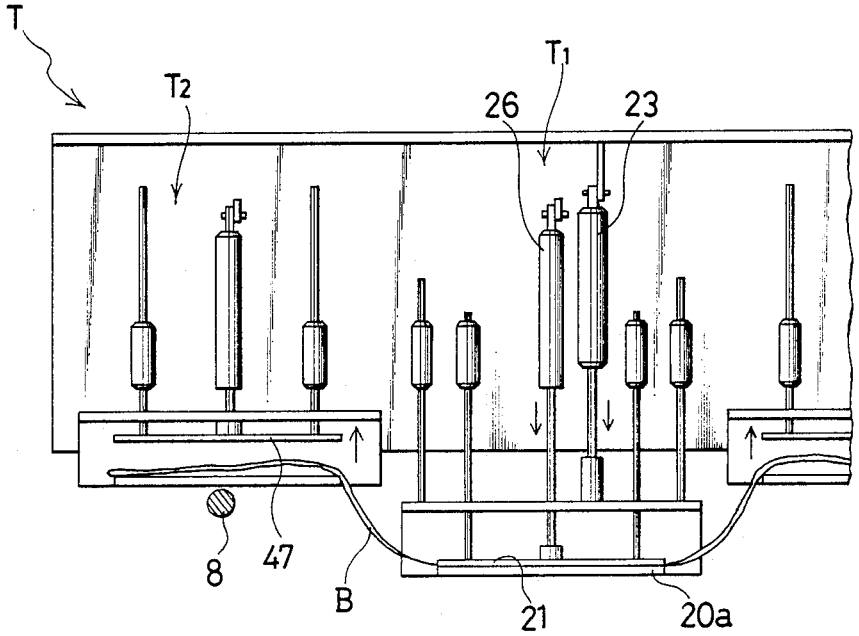
In FIG. 13, a veneer holder of a central holding element is in its lower position.

For the apparatus according to the invention, a veneer holding mechanism T shown in FIGS. 12 and 13 may be used, instead of the mechanism Q, to hold the sheet A. The veneer holding mechanism T comprises three separate holding elements $T_1$, $T_2$ and $T_2$. The holding element $T_1$ is a central holding element. The two holding elements $T_2$ and $T_2$ are located on opposed sides of the central element $T_1$, respectively. The central holding element $T_1$ has the same construction as the entire veneer holding mechanism Q of FIG. 2. Each outer holding element $T_2$ has the same construction as the central holding element $T_1$ except that only one piston-type cylinder 49 and only two support rods 50 are provided. Each support rod 50 is supported by a linear ball bearing 51 supported from the vertical plate of the T-shaped member 7. The two support rods 50 are located on opposed sides of the cylinder 49. The piston rod of the cylinder 49 and the two support rods 50 project downward from an upper horizontal plate of the body of a veneer holder 46 at their lower end portions. A horizontal press plate 47 is connected to the lower end of the piston rod of the cylinder 49 and to the lower ends of the two rods 50. When the piston rod of the cylinder 49 is raised or lowered, the press plate 47 is raised or lowered. The operation of the central element $T_1$ is the same as that of the entire holding mechanism Q of FIG. 2. Thus, not only the entire holder 20 of the central holding element $T_1$ is vertically movable, but also the press plate 21 thereof is vertically movable relative to the U-shaped body of the holder 20. However, the press plate 47 of the holder 46 of each outer holding element $T_2$ is vertically movable relative to the U-shaped body of the holder 46, but the entire holder 46 is not movable. As with the holding mechanism Q of FIG. 2, an air source (not shown) such as an air tube is connected to each cylinder of the central element $T_1$ by means of a conduit (not shown), and supplies compressed air to each cylinder. Also, an air source (not shown) such as an air tube is connected to the cylinder 49 of each outer holding element $T_2$ by means of a conduit (not shown), and supplies compressed air to each cylinder 49. An electromagnetic valve (not shown) is provided in each conduit, and is interconnected to the controller 44. The controller 44 controls each valve to open or close it in order to supply each cylinder with the compressed air from the source or interrupt the supply of the compressed air therefrom. The distance between the left-hand edge of the left-hand holder 46 and the right-hand edge of the right-hand holder 46 is substantially the same as the length of the holder 31 of FIG. 4.

Figure 14:
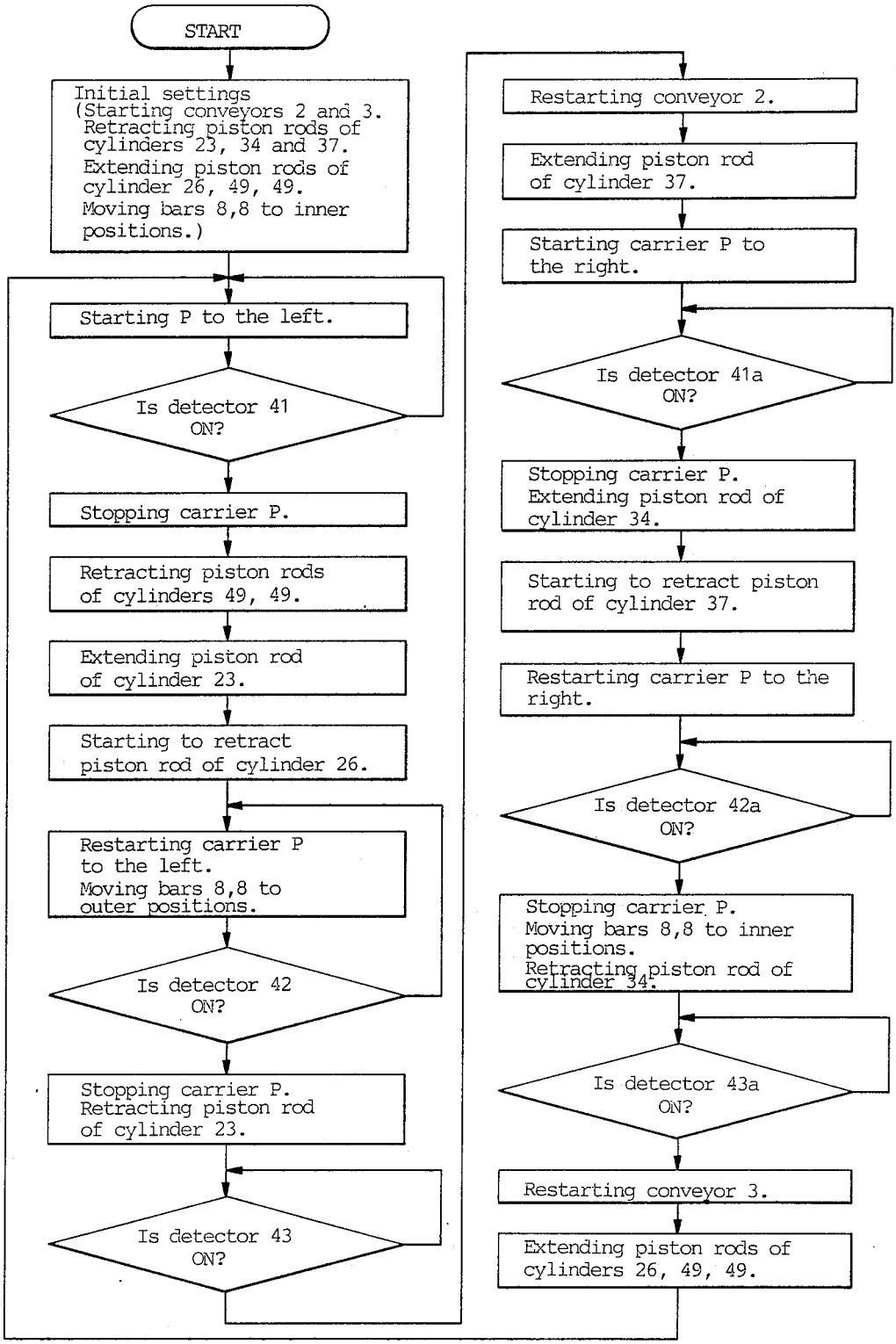
FIG. 14(*a*) shows an operating program used when the veneer holding mechanism of FIG. 12 is employed.
Figure 14B:
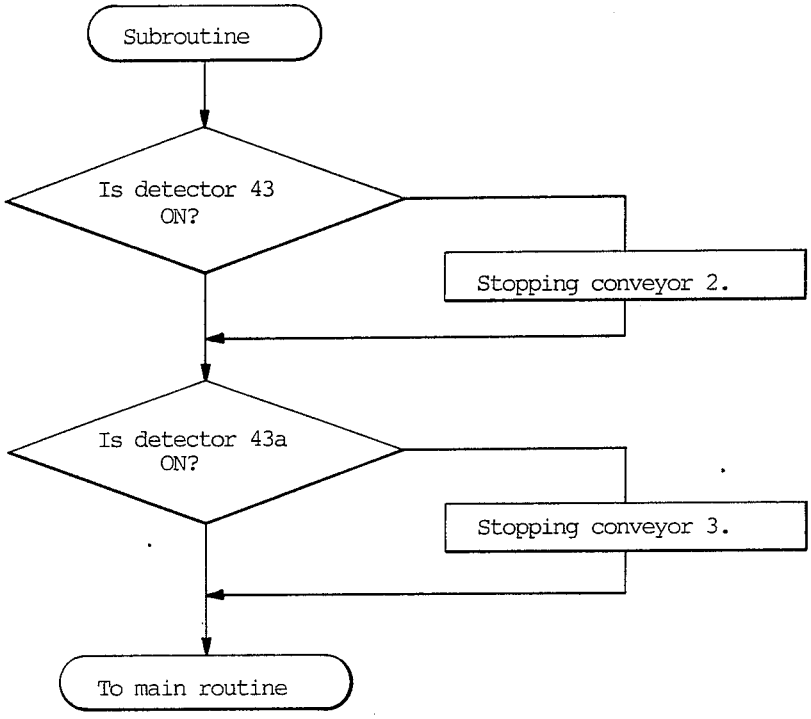

In the case where the veneer holding mechanism T is used instead of the mechanism Q, the controller 44 is provided with a control program of FIG. 14(*a*) which has a subroutine of FIG. 14(*b*).

In use of the apparatus with the holding mechanism T, after dropping the sheet A, the carrier P comes to its second right-hand position where the carrier P is detected by the detector 42*a* and is stopped. The sheets B are moved into the three holders 46, 20 and 46 of the veneer holding mechanism T until practically the entire front edge of the sheets B comes in contact with the vertical plates of the holder bodies (FIG. 12). Then, the piston rods of the cylinders 49 and 49 and the piston rod of the cylinder 26 are simultaneously extended, and thus the three press plates 47, 21 and 47 simultaneously lower to hold the front end portion of the sheets B together with the three lower horizontal plates 46*a*, 20*a* and 46*a*.

Then, the carrier P is moved to the left while holding the sheets B. The sheets B are carried by the carrier P while being supported from below by the bars 8. When thus carried, the sheets B are downwardly curved in their rearward portion for the same reasons as in the case where the sheets B are held by the holding mechanism Q of FIG. 2. When the carrier P has come to its first left-hand position, it is detected by the detector 41 and is stopped there. Then, the piston rods of the two cylinders 49 are retracted, and thus the two press plates 47 release hold on the sheets B. Then, the piston rod of the cylinder 23 is extended, and thus the entire central holder 20 lowers to its lower position (FIG. 13). Therefore, the portion of the sheets B held by the central holder 20, that is, the middle of the front end portion of the sheets B is lowered relative to the rest of the front end portion thereof (FIG. 13). Hence, the forward portion of the sheets B is downwardly curved like its rearward portion. Thus, the entire sheets B are uniformly curved in a downward direction while being supported by the bars 8.

Then, the piston rod of the cylinder 26 starts to be retracted, and thus the press plate 21 releases its hold on the sheets B. The entire holder 31 is still in its lower position (FIG. 11). Then, the carrier P is restarted to the left side, and at the same time the support bars 8 are moved to their outer positions. Thus the sheets B become unsupported by anything, and drop by gravity on the sheet A previously placed on the sheet C on the table 1. When the carrier P has come to its second left-hand position, the carrier P is detected by the detector 42 and stopped there, and the piston rod of the cylinder 23 is retracted to return the entire holder 20 to its upper position.

In the case where the veneer holding mechanism Q is used, the sheets B may tear in the direction perpendicular to the direction of the fibers of the sheets B when the sheets B start to be carried by the carrier P, because the front end portion of the sheets B is only partly held by the mechanism Q. However, with the veneer holding mechanism T, such a possibility is minimized because the mechanism T holds practically the entire front end portion of the sheets B.

It is not necessarily required that all detectors 41, 41*a*, 42, 42*a*, 43 and 43*a* be located in the illustrated positions. Instead, each detector may be located in other such position that the detector detects the carrier P or the sheet A or sheets B in the position in and from which the carrier or the sheet or sheets would be stopped and restarted if the detector were located as illustrated. Also, if desired, all illustrated carrier detectors 41, 41*a*, 42 and 42*a* may be omitted, and instead one pulse oscillator may be provided in the operating mechanism 6*a* as a means for performing the same functions as the illustrated carrier detectors. The pulse oscillator may be such as to emit pulse signals as the carrier P moves, and the pulse signals emitted are counted to determine where the carrier P is. Also, the illustrated veneer detectors 43 and 43*a* may be omitted, and instead one pulse oscillator may be provided in the drive mechanism of each conveyor as a means for performing the same function as the detector 43 or 43*a*. Also, a servomotor may be employed as the operating mechanism 6*a* as the drive mechanism of each conveyor. In such a case, required positions of the carrier or of the conveyor may be stored in the servo-amplifier to use the servomotor itself as the required detector. Also, if desired, phototube switches or the like may be used as the detectors 41 and 41*a*, and may be located to directly detect the sheet A and sheets B in such a manner that the sheet A and sheets B are stopped where they are to be dropped.

In the case where all sheets to be stacked on the table do not have the same length, that is, are not the same in their dimensions in the directions of conveyance thereof, the sheets stacked on the table may not be exactly aligned in a vertical direction at either their ends nearer to the conveyor 2 or their ends nearer to the conveyor 3. In such a case, however, their ends nearer to either conveyor may be exactly aligned by modifying the apparatus as follows: The illustrated detector 41 is omitted, and instead a phototube switch is used. The phototube switch is located in a position which is inward of the illustrated detector 41 and where the phototube switch detects the front end of the sheets B held by the carrier P when the sheets B have come to the same leftmost position as they are carried when the illustrated detector 41 is used. Thus, when the phototube switch is used as a carrier detector, the sheets B can be stacked in the same position on the table as they are stacked when the illustrated detector 41 is used. Also, one and the same phototube switch located in the foregoing position may be employed as a means equivalent to the illustrated detector 41*a*. That is, the phototube switch also can detect the rear end portion of the sheet A in the same position as the front end of the sheets B is detected. Thus, all sheets conveyed and carried from the opposed directions can be stacked in such a manner that the right-hand edges of all the sheets are aligned in a vertical direction. In short, the abovementioned problem can be solved by omitting the illustrated detectors 41 and 42*a* and instead using a phototube switch in the foregoing position.

Also, if desired, the veneer detector 43*a* may be located such that, whether the carrier P has already reached its second right-hand position or not, the sheets B on the conveyor 3 come straight to the position where the front end portion of the sheets B is held by the downward movement of the press plate 21. By effecting such a modification, if the sheets B have already been detected by the detector 43*a* before the carrier P reaches its second right-hand position, the press plate 21 of the holding mechanism Q may be lowered immediately after the carrier P reaches its second right-hand position and, thus, time may be saved. Needless to say, the veneer detector 43 may also be located in a similar manner.

Figure 15:
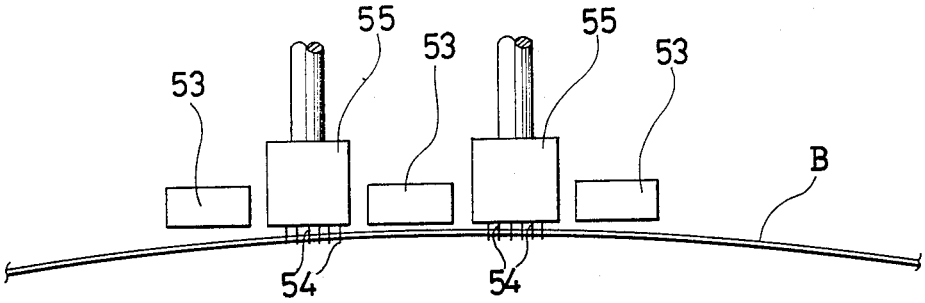
FIG. 15 shows one different embodiment of a veneer holding mechanism.

In any one of the veneer holders 20 (FIGS. 2 and 12), 31 (FIG. 4), and 46 (FIG. 12), the press plate (such as 21) movable relative to the holder body holds the sheet A or sheets B together with the lower horizontal plate (such as 20*a*) immovable relative to the holder body. However, if desired, the veneer holding mechanism may be modified in such a manner that a pair of upper and lower press plates both movable relative to the holder body hold the sheet A or sheets B. Also, a fundamentally different veneer holding mechanism of FIG. 15 may be used. The holding mechanism of FIG. 15 includes vertically-movable holder elements 55 and vertically-movable levers 53 for removing, or dropping the sheet from the holder elements 55. The holder elements 55 and levers 53 are arranged in a direction perpendicular to the direction of conveyance of the sheet. Each holder element 55 is provided, at its bottom, with needles 54 to penetrate the sheet to hold it. The holder elements 55 and the levers 53 are suspended from the upper plate of the T-shaped member 7. Also, a mechanism for attracting the sheet by air to hold it may be used instead of the illustrated mechanisms.

Figure 16:
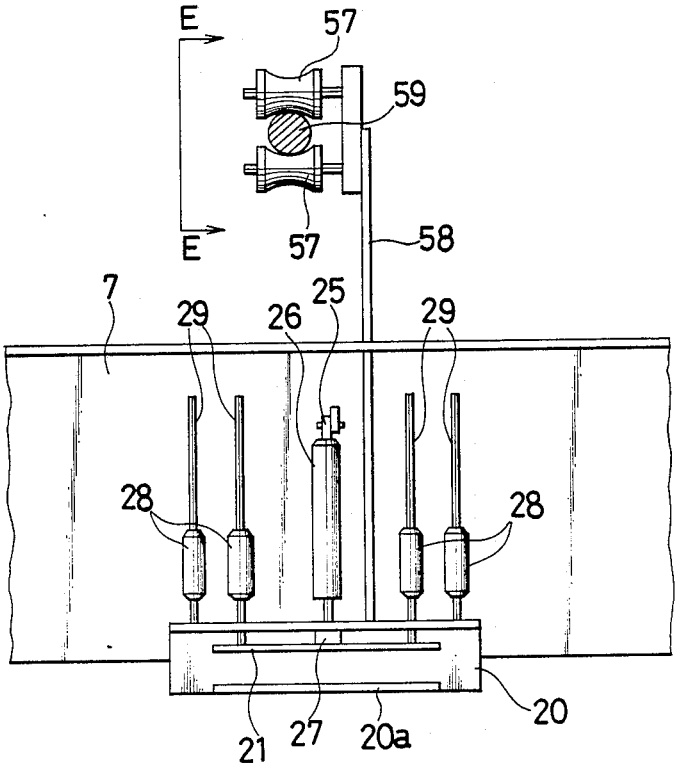
FIG. 16 shows a modification of the holding mechanism Q.
Figure 17:
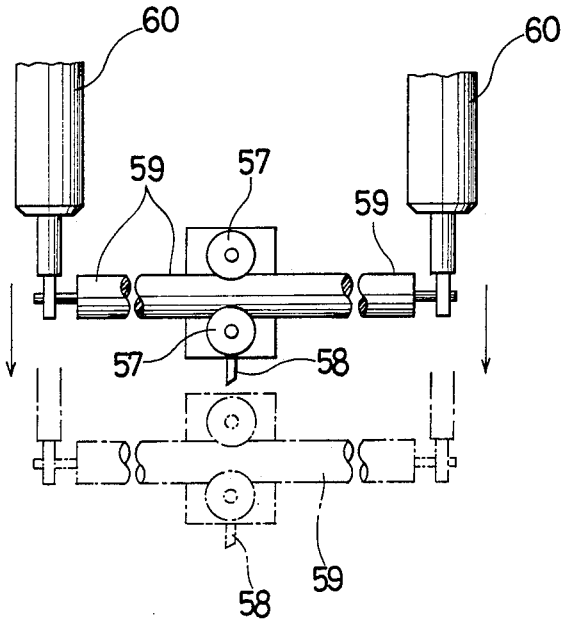
FIG. 17 shows a portion of the mechanism of FIG. 16 as viewed in an E—E direction of FIG. 16.

The apparatus of the invention may be modified such that veneer sheets conveyed only from one direction are stacked on the table. In such a case, the veneer carrier P may be provided with only one veneer holding mechanism. And where only one veneer holding mechanism is provided, for example, such a mechanism may be constructed, as shown in FIG. 16, in such a manner that a veneer holder is vertically moved by a means different from that of the preceding embodiments. A veneer holding mechanism of FIG. 16 is a modification of the veneer holding mechanism Q of FIG. 2. In this modification, no cylinder such as the cylinder 23 is directly connected to the frame of the carrier P and to the holder 20 for vertically moving the holder 20. Instead, an upright bar 58 is connected to the upper horizontal plate of the holder 20. The bar 58 is suspended from a vertical rectangular plate, and extends through the horizontal plate of the T-shaped member 7. A pair of upper and lower horizontal shafts projects from the rectangular plate, and a pair of upper and lower wheels 57 are mounted on the respective shafts. The diameter of each wheel 57 is smaller toward its middle portion. A rail 59 with a circular cross section is provided between the wheels 57, and extends in the direction in which to move the carrier P. The wheels 57 are in engagement of the rail 59. When the carrier P is moved, the wheels 57 move along the rail 59. As shown in FIG. 17, the rail 59 is supported by a pair of piston-type cylinders 60 at its opposed end portions. The piston rods of the cylinders 60 are synchronously moved to raise or lower the rail 59. When the rail 59 is lowered (as indicated by broken lines of FIG. 17), the veneer holder 20 moves to its lower position. When the rail 59 is raised (as indicated by solid lines of FIG. 17), the veneer holder 20 moves to its upper position. When the rail 59 is in its raised position, the carrier P is moved to the left (in FIG. 1) while holding the sheets B. When the carrier P has come to its first left-hand position, the carrier P is detected by the detector 41 and is stopped there. Then, the rail 59 is lowered to move the holder 20 to its lower position. Then, the holder 20 releases its hold on the sheets B, and the carrier P is moved to its second left-hand position and stopped there. In this position the rail 59 is raised to return the holder 20 to its upper position. In such a modification, since the cylinder 23 is omitted, the mass of the entire carrier P is smaller. Therefore, the shock given to the carrier P when starting or stopping it is smaller and, hence, the sheets may be stacked with a higher positional accuracy. If desired, only one cylinder 60 may be provided to support the rail 59 at its one end portion and to move the rail 59 vertically, and the other end portion of the rail 59 may be pivotally supported. Also, eccentric cams or eccentric wheels may be used instead of the cylinders 60. Furthermore, the holder 20 may be vertically moved not by movably supporting the rail 59, but by using a rail which is downwardly curved to lower the holder 20 in the required position. By so doing, the entire apparatus may be made more simple in its construction.

For the modification of FIGS. 16 and 17, if desired, a rail with a cross section other than a circular one may be used. Also, more than one pair of wheels 57 may be provided. Also, wheels with shapes different from the illustrated shape may be used. Also, the wheels 57 may be supported by a means other than the shafts.

If desired, a mechanism similar to the mechanism of FIGS. 16 and 17 may be used, instead of the cylinder 26, for the press plate 21.

In FIG. 1, the chains 6 and its associated mechanism may be omitted, and instead, rails along which to move the carrier may be provided. In such a case, the carrier may be provided with wheels for moving the carrier along the rails.

Also, in FIG. 1, if the apparatus is used to stack sheets conveyed only from one direction, the chains 6 may be operated only in one direction.

In the foregoing embodiments, the veneer holder of each veneer holding mechanism is moved to its lower position after the carrier P reaches its first left-hand or right-hand position. However, if desired, the holder may be lowered before starting the carrier from its first right-hand or left-hand position. Also, the holder may be lowered while moving the carrier to its first left-hand or right-hand position. Also, in the foregoing embodiments, the holder of each veneer holding mechanism is returned to its upper position before the carrier returns to its second left-hand or right-hand position. However, if desired, the holder may be returned to its upper position after returning the carrier to its second left-hand or right-hand position.

If the material of sheets conveyed by the conveyor 3 is such that the sheets are downwardly curved, at their rearward portions, much more greatly than the sheets in FIG. 8, the rearward portion of the sheets is still in the state of being curved more than the forward portion thereof even after the forward portion has been curved by lowering the middle of the front end portion thereof. In such a case, the sheets may not drop to a position substantially directly below the position from which the sheets start to be dropped, but make a landing in a position appreciably nearer to the conveyor 2. There are two ways to solve this problem. One way is to provide the table 1 with a means for controlling the height of the table in such a manner that the uppermost one of the sheets stacked on the table is, at all times, on the level which is below the support bars 8 and beyond which the rearward portion of the sheets supported on the bars 8 must not curve. The rearward portion of the sheets on the bars 8 may be supported by the uppermost sheet on the table and thus prevented from curving beyond the foregoing level. Another way is illustrated in FIG. 10, and is to provide a guide bar or bars 52 such that the bar 52 may be moved between an inner higher position (indicated by a broken line) where the uppermost edge of the bar 52 is at substantially the same level as the lower end of the veneer holder when the holder is in its lower position and an outer lower position (indicated by a solid line) where the entire bar 52 does not impede the stacking operation. Such a guide bar may be interconnected to the controller 44 such that the controller 44 moves the bar 52 to its inner position from its outer position at the same time when the carrier P starts to carry the sheets, and retracts the bar 52 to its outer position immediately before dropping the sheets. When the bar 52 is in its inner position, the bar 52 may support the rearward portion of the sheets (supported) on the bars 8 to substantially prevent that portion from curving beyond the level to which the forward portion of the sheets are curved by the holder 20.

Figure 5A:
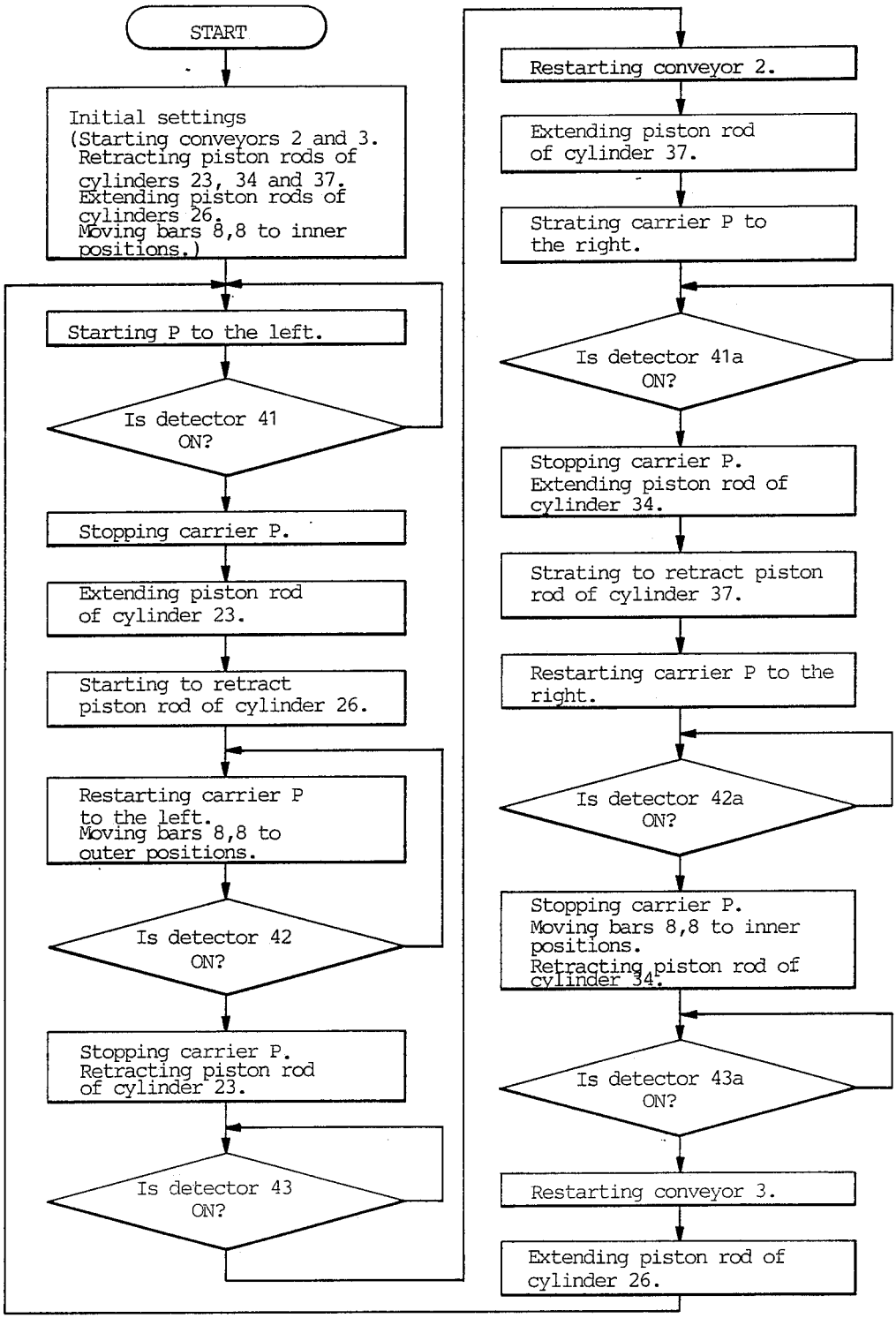
FIG. 5(*a*) shows a program for operating the apparatus of FIG. 1.
Figure 5B:
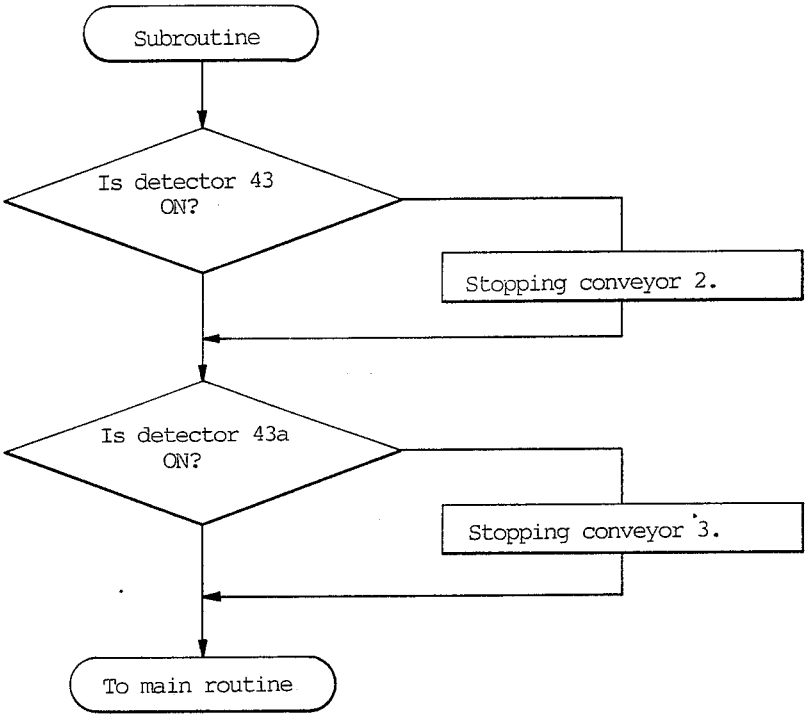

If desired, mechanical means for temporarily stopping the sheet A or sheets B may be provided for the respective conveyors so that the mechanical means can be moved onto the conveyors, and the subroutine of FIG. 5(*b*) or 14(*b*) may be modified to eliminate the operations of temporarily stopping the conveyors, after detection of the sheets, to stop the sheets and instead to move the foregoing mechanical means thereafter onto the conveyors for the same purpose, and in the main routine of FIG. 5(*a*) or 14(*a*) the steps of restarting the conveyors may be replaced with the steps of clearing the mechanical stopper means from on the conveyors. Thus, in such a case, the conveyors are continuously operated.

If necessary, the table 1 and its legs 1*a* may be completely omitted, and instead a conveyor may be located such that one end portion thereof is positioned between the conveyors 2 and 3 and provides a means equivalent to the table 1. In such a case, the sheets stacked on the conveyor may be automatically conveyed to the next stage of work.

The apparatus of the invention may be considerably modified by omitting the conveyor 2 and instead providing a conveyor means on the same side as and at a level lower than the conveyor 2, which conveyor means is capable of being extended between the table and veneer sheets B carried to the required position by the carrier P. In such a modification, the foregoing conveyor means is extended to convey a veneer sheet thereon to the required position between the table and the sheets B, and the sheets B are dropped on the sheet A to place the former on the latter, and then the sheets A and B are dropped together on the table by retracting the conveyor means. In this modification, the table 1 is kept, at all times, at a level considerably lower than the conveyor means. Also, in this modification, the veneer holding mechanism R is not used. This modification provides the advantage that the veneer sheets stacked on the table may have a better vertical alignment in their edges.

According to the invention, veneer sheets may be stacked exactly, or such that their edges are aligned in vertical directions. Therefore, it is not necessary to use veneer sheets larger than necessary in anticipation of nonalignment. This advantage improves the yield of the veneer sheets.

What is claimed is:

1. An apparatus for stacking veneer sheets, comprising (a) a stack support upon which to stack veneer sheets;

(b) a first conveyor means for intermittently supplying veneer sheets toward the stack support, said conveyor means having one end in proximity to said stack support;

(c) a veneer detector means for detecting a veneer sheet when the veneer sheet on the conveyor has come to a predetermined discharge position;

(d) transport means for carrying the sheet from the discharge position to a predetermined drop position above the stack support, said transport means having (I) a veneer carrier for holding at a first, starting position a substantial middle of a front end portion of the sheet conveyed to said discharge position by said conveyor, and carrying the sheet therefrom to said drop position, and (II) a pair of spaced-apart support means, for selectively supporting opposed side portions of the sheet while allowing a substantial rear half of the sheet to curve downwardly, said support means being oriented in the direction of travel of the sheet, and being movable between operative positions to support the sheet and non-operative positions to not support the sheet;

(e) a first carrier detector means for detecting the veneer carrier when the veneer carrier has come to the first position;

(f) a second carrier detector means for detecting the veneer carrier when the veneer carrier has come to a second position where the veneer carrier has the sheet in the drop position;

(g) means for imparting a downward curvature to the front end portion of the sheet such that the entire sheet has a substantially uniform downward curvature before the sheet is dropped, the veneer carrier releasing its hold on the sheet once the entire sheet has achieved the substantially uniform downward curvature;

(h) actuating means for keeping the support means in the support positions from the time that the sheet begins to be carried to the drop position until the entire sheet has become uniformly curved downwardly, and moving the support means to the non-operative positions after the veneer carrier has started to be moved from the second position to a third position where the veneer carrier no longer supports the sheet;

(i) a third carrier detector means for detecting the veneer carrier when the veneer carrier has come to the third position, (j) a drive mechanism for reciprocating the veneer carrier between the first and third positions; and (k) a controller means responsive to the detection of the sheet by the veneer detector means for controlling the operation of the conveyor and responsive to the detection of the veneer carrier by the first, second and third carrier detector means for controlling the operations of the conveyor, of the drive mechanism, of the actuating means and of the curving means.

2. The apparatus of claim 1 further comprising a second conveyor means disposed opposite the first conveyor means for supplying core veneers toward the stack support.

3. The apparatus of claim 2 wherein the transport means is movable between the first and second conveyor means.

4. The apparatus of claim 1 wherein the veneer carrier includes a lower plate and an upper plate, said upper plate being downwardly movable to press the middle, front end portion of the veneer sheet against the lower plate in order to hold that portion of sheet together with the lower plate while the sheet is in the discharge position, and being upwardly movable to release its hold on the sheet once the sheet has been uniformly curved downwardly, in the drop position.

5. The apparatus of claim 11 wherein said veneer carrier includes (a) needle means for penetrating the middle, front end portion of the veneer sheet conveyed to said discharge position in order to hold the sheet and (b) means for removing the sheet from said needle means when the entire sheet is in the state of being uniformly curved downwardly in said drop position.

6. The apparatus of claim 1 wherein the means for imparting curvature is acuated while the sheet is being conveyed to the drop position.

* * * * *

UNITED STATES PATENT AND TRADEMARK OFFICE

CERTIFICATE OF CORRECTION

PATENT NO. : 4,897,018

DATED : January 30, 1990

INVENTOR(S) : Nakaoda et al.

It is certified that error appears in the above-identified patent and that said Letters Patent is hereby corrected as shown below:

Column 2, line 12, please delete "he veneer" and insert --the veneer--.

Column 16, line 58, please delete "claim 11" and insert --claim 1--.

Signed and Sealed this

Seventh Day of January, 1992

*Attest:*

HARRY F. MANBECK, JR.

*Attesting Officer*

*Commissioner of Patents and Trademarks*